US006415848B1

(12) United States Patent
Komazaki et al.

(10) Patent No.: US 6,415,848 B1
(45) Date of Patent: Jul. 9, 2002

(54) METAL MOLD ARRANGEMENT FOR PRODUCING CYLINDER BLOCK

(75) Inventors: Toru Komazaki; Shin Nitta; Tatsuya Manabe, all of Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 09/781,266

(22) Filed: Feb. 13, 2001

(51) Int. Cl.[7] ..... B22D 29/00; B22D 33/04

(52) U.S. Cl. ..... 164/340; 164/345; 164/369; 164/132

(58) Field of Search ..... 164/137, 340, 164/132, 345, 346, 369

(56) References Cited

U.S. PATENT DOCUMENTS 5,690,159 A 11/1997 Mizukusa ..... 164/132

FOREIGN PATENT DOCUMENTS

| | | |
|---|---|---|
| JP | 7-108449 | 11/1995 |
| JP | 9-70645 | 3/1997 |
| JP | 2000-42708 | 2/2000 |

OTHER PUBLICATIONS

Abstract JP7108449B Jan. 7, 1991.
Abstract JP19950255659 Nov. 25, 1997.
Patent Abstracts of Japan 2000–042708 Feb. 15, 2000.

*Primary Examiner*—Kuang Y. Lin
(74) *Attorney, Agent, or Firm*—Sughrue Mion, PLLC

(57) ABSTRACT

A metal mold arrangement for producing a closed deck type cylinder block in which a plurality of bridge portions partly cover an open end of a water jacket at a top deck side of the cylinder block. A water jacket die provides a configuration of a water jacket. A plurality of recesses are formed in the water jacket die, and each separate core having a shape complementary to the recess is insetted in each recess. Each separate core has a top deck side end face and a crank case side end face opposite thereto. The two faces are slanted in a direction opposite to each other for serving as drafts. A bottom of each recess is also slanted coincident with the slant of the top deck side end face, and each bridge portion is formed adjacent the bottom of the recess. Upon solidification of a molten metal, the water jacket die is removed from the casted product while each separate core remains in a resultant water jacket. Each of the separate core can be moved toward a direction to increase a distance between the end faces within the water jacket and can be offset from each bridge portion, thereby removing the separate core from the water jacket.

19 Claims, 4 Drawing Sheets

METAL MOLD ARRANGEMENT FOR PRODUCING CYLINDER BLOCK

BACKGROUND OF THE INVENTION

The present invention relates to a metal mold arrangement for producing a cylinder block of an internal combustion engine, and more particularly to a type thereof having separate cores.

For cooling an internal combustion engine, a cylinder block is formed with a water jacket surrounding a plurality of cylinder liners juxtaposedly arranged with each other. Further, a closed deck type cylinder block has been provided in which bridge portions are provided to partly cover an open end of the water jacket at a top deck side of the cylinder block in order to reduce vibration of the engine and to reinforce the cylinder block. A crank case is provided at a side opposite the top deck.

For casting the cylinder block, a metal mold is provided whose internal configuration is coincident with an external shape of the cylinder block, and a water jacket die is positioned within the metal mold. Further, a protruding die is positioned within the water jacket die for defining a cylinder bore. A water jacket appears upon pulling out the water jacket die after solidification of a molten metal. Because the bridge portions are provided at the top deck side upon casting, it is necessary to place separate cores at positions corresponding to the bridge portions in order to allow the water jacket die to be pulled out from the casted product.

Japanese Patent Application Kokai No. Hei-9-70645 discloses a water jacket die formed with a plurality of recessed portions each extending in an axial direction of a cylinder liner. Separate cores each fittable with each recessed portion are provided for forming bridge portions. The separate cores are solid structure and are formed from ferrous material. Each separate core is subdivided into two pieces whose parting faces extend in the axial direction of the cylinder liner. The subdivided two pieces have upper and lower surfaces slanted into generally V-shape such that a distance between the upper and lower surfaces is gradually increased toward a direction away from the parting faces in the circumferential direction of the water jacket in order to provide a draft or a slope. Further, each subdivided two piece has a thickness in a radial direction of the cylinder liner, the thickness being gradually increased toward a direction away from the parting face in the circumferential direction in order to provide a slide draft or slope.

At each bottom of each recessed portion of the water jacket die, a projection is provided for forming an opening in an ultimate cylinder block. Therefore, when each separate core is fitted in each recessed portion, the lower surface of the separate core is mounted on the projection in such a manner that the parting faces of the subdivided pieces are in alignment with the projection. Because of the provision of the projection, a space is defined between the lower surface of the separate core and the bottom surface of the recessed portion, so that the molten metal can be filled in the space to provide the bridge.

After opening the metal mold, the water jacket die is pulled out from the casted product remaining the separate cores within the water jacket. A bore is formed in each bridge portion at a position corresponding to the projection. By inserting a jig through the bore, the two subdivided pieces of the separate core are pushed and moved away from each other, so that the separated subdivided pieces are pivotally moved about each lower corner. Accordingly, each upper surface of the subdivided pieces can be offset from the bridge portion. Thus, the subdivided pieces can be removed from the cylinder block through the upper open end of the water jacket.

In the water jacket die according to the Japanese Patent Application Kokai No.Hei-9-70645, each separate core can be easily removed from the water jacket by pivotally moving the subdivided pieces in a direction away from each other upon insertion of the jig and pushing the jig onto the parting faces of the subdivided pieces. Further, because the separate cores are formed by the solid metallic material, the separate core can be produced easily and can withstand casting pressure.

However, due to the subdivided construction, it would be rather difficult to set the separate core at a given position, and precise clearance is required between the separate core and the metal mold. Thus, high dimensional accuracy is required in the separate cores and the water jacket dies. Particularly, in order to remove the separate cores from the water jacket, the subdivided pieces are moved away from each other in the water jacket and in a direction away from the bridge portions. Consequently, a proper dimensional relationship is required between a size of the subdivided pieces and a thickness (a length in a radial direction of the cylinder) of the water jacket at the moving area of the subdivided pieces, otherwise the subdivided pieces cannot be removed out of the water jacket. In this respect, the water jacket die must provide high dimensional accuracy. Moreover, a metal penetration may occur at a contact surface between the separate cores and the metal mold, which in turn generate burrs. Thus, a work for removing the burrs from the metal mold is required, which lowers productivity. In particular, since the parting faces between the subdivided pieces are positioned immediately below the casted bridge portion, burr removal work becomes difficult due to the existence of the bridge portion. Further, since the bore is formed in the bridge portion, mechanical strength of the bridge portion may be lowered. Furthermore, the jig must be required which must be properly sized to be insertable through the bore.

Japanese Patent Publication No.Hei7-108449 discloses a hollow metallic separate core fittable in a recessed portion of a water jacket die in order to form a bridge portion at a top deck of a cylinder block. After the bridge portion is casted at the top deck side, the water jacket die is pulled out of the water jacket while the separate core remains in the water jacket. In this case, vertical side faces of the separate core extend in an axial direction of the cylinder and are positioned offset from the bridge portion. Thus, a drilling machine is accessible to the vertical side faces. By removing the vertical side faces by the drilling machine, the water jacket can be entirely fluidly connected around the cylinder liners because the separate core are hollow construction. If high casting pressure is applied, sand can be filled in the hollow separate core in order to increase strength of the core. In the latter case, the sand can be discharged out of the water jacket upon removal of the vertical side faces of the separate core.

However, according to the method for producing the cylinder block disclosed in the Japanese Patent Publication No.Hei7-108449, drilling work is required for removing the vertical side faces of the separate core after casting in order to provide a complete fluid communication in the water jacket. This work requires skill. Further, a production of the separate core is rather difficult due to the hollow structure. Furthermore, sand must be filled in the hollow separate core in case of the casting at a high casting pressure. In the latter case, sand discharging work must be required to lower the productivity.

SUMMARY OF THE INVENTION

It is therefore an object of the present invention to provide an improved metal mold arrangement for producing a cylinder block of an internal combustion engine, the arrangement being capable of facilitating setting of each separate core into a metal mold and facilitating removal of each separate core from the water jacket.

Another object of the invention is to provide such metal mold arrangement in which a design of a water jacket die is not subjected to severe requirement, and burr occurring portions can be reduced, and burr removal work can be easily performed.

Still another object of the invention is to provide such metal mold arrangement capable of providing a relatively large area of bridge portions and facilitating production of the separate cores.

These and other objects of the present invention will be attained by an improved metal mold arrangement for producing a closed deck type cylinder block made from an aluminum alloy. The cylinder block has a plurality of cylinder bores juxtaposed with each other to form a cylinder array and is formed with a water jacket surrounding the cylinder array. The cylinder block also has a top deck at which one end of the water jacket is defined as an open end, a plurality of bridge portions partly covering the open end, and a crankcase side end face opposite the top deck. The metal mold arrangement including a cylinder block forming die and a plurality of separate cores. The cylinder block forming die includes at least a first wall portion defining a configuration of the top deck, a cylindrical protruding sections for defining an inner configuration of the cylinder block, a second wall portion defining a configuration of the crankcase side face, and a water jacket die portion positioned to surround the cylindrical protruding sections for defining a configuration of the water jacket. The water jacket die portion is formed with a plurality of recesses extending in an axial direction of the cylinder bores and opening at the crankcase side face. Each recess is a rectangular shape having a pair of side wall surfaces, an opening positioned at the crankcase side face, and a bottom wall surface opposite the opening. The bottom wall surface extends in a direction intersecting with the axial direction and is oblique to a direction of the array of the cylinders. The bottom surface is partly open to the first wall portion. Each of the plurality of separate cores has a solid structure and is made from a metal and has a rectangular shape complementary with each recess. Each single one of the separate cores is insertable into each recess in the axial direction from its opening. Each separate core has a top deck side slant end face serving as a first draft and a crankcase side slant end face serving as a second draft. The top deck side face and the crankcase side face are slanted in opposite direction against each other such that a distance between the top deck side slant end face and the crankcase side slant end face in the axial direction of the cylinder is gradually increased in a circumferential direction of the cylinder. An inclination of the bottom wall surface of each recess is coincident with an inclination of the top deck side slant end face.

According to the metal mold arrangement of the present invention, setting of the separate core in the metal mold can be facilitated because not subdivided two pieces but a single separate core is to be positioned in each recessed portion. Further, an area of each bridge portion can be increased to enhance mechanical strength because formation of a hole in each bridge portion is not required. Furthermore, it is unnecessary to prepare and use a special jig to be inserted into the hole. Further, since only a single separate core is required for the corresponding recessed portion, merely moving the separate core within the water jacket space toward the neighboring cylinder can remove the core from the cylinder block. In other words, a simple design for the water jacket die portion can result. This is in high contrast to the arrangement in JP Hei9-70645 in which subdivided pieces must be moved in opposite directions, so that special care is required in the water jacket space design for allowing the subdivided pieces to be moved in the opposite directions. Further, the single separate core does not provide therein a parting face. Accordingly, burr generating portion can be reduced, and easy burr removal work can result. Further, since the separate core is of a solid structure, such a core can sustain high casting pressure without any deformation, and the core can be produced easily in comparison with a separate core of a hollow structure.

DETAILED DESCRIPTION OF THE PREFERRED EMBODIMENTS

A metal mold arrangement for producing a closed deck type cylinder block according to one embodiment of the present invention will be described with reference to FIGS. 1 through 4.

Figure 1:
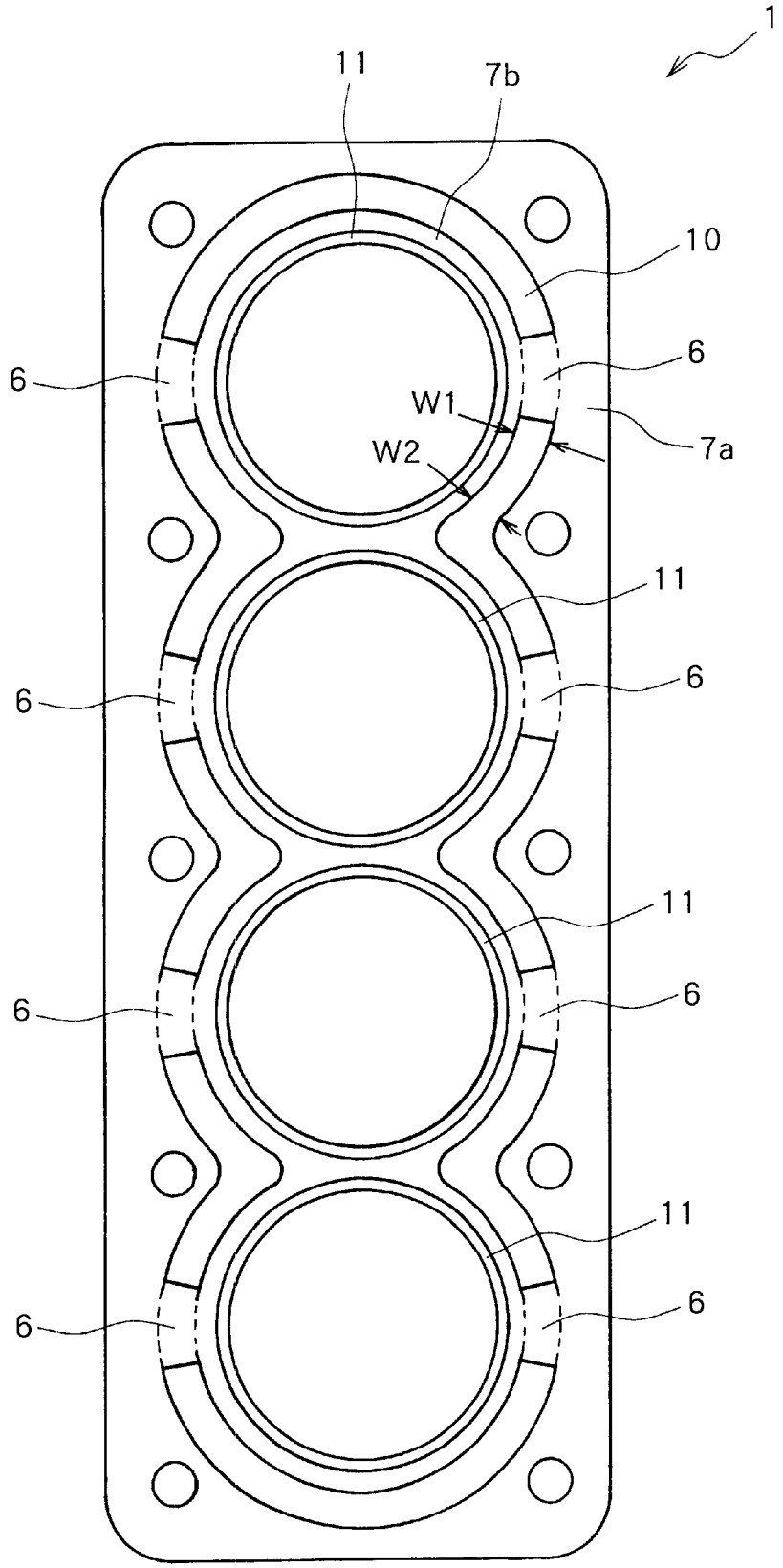
FIG. 1 is a plan view showing a closed deck type cylinder block produced by a metal mold arrangement according to one embodiment of the present invention.
Figure 2:
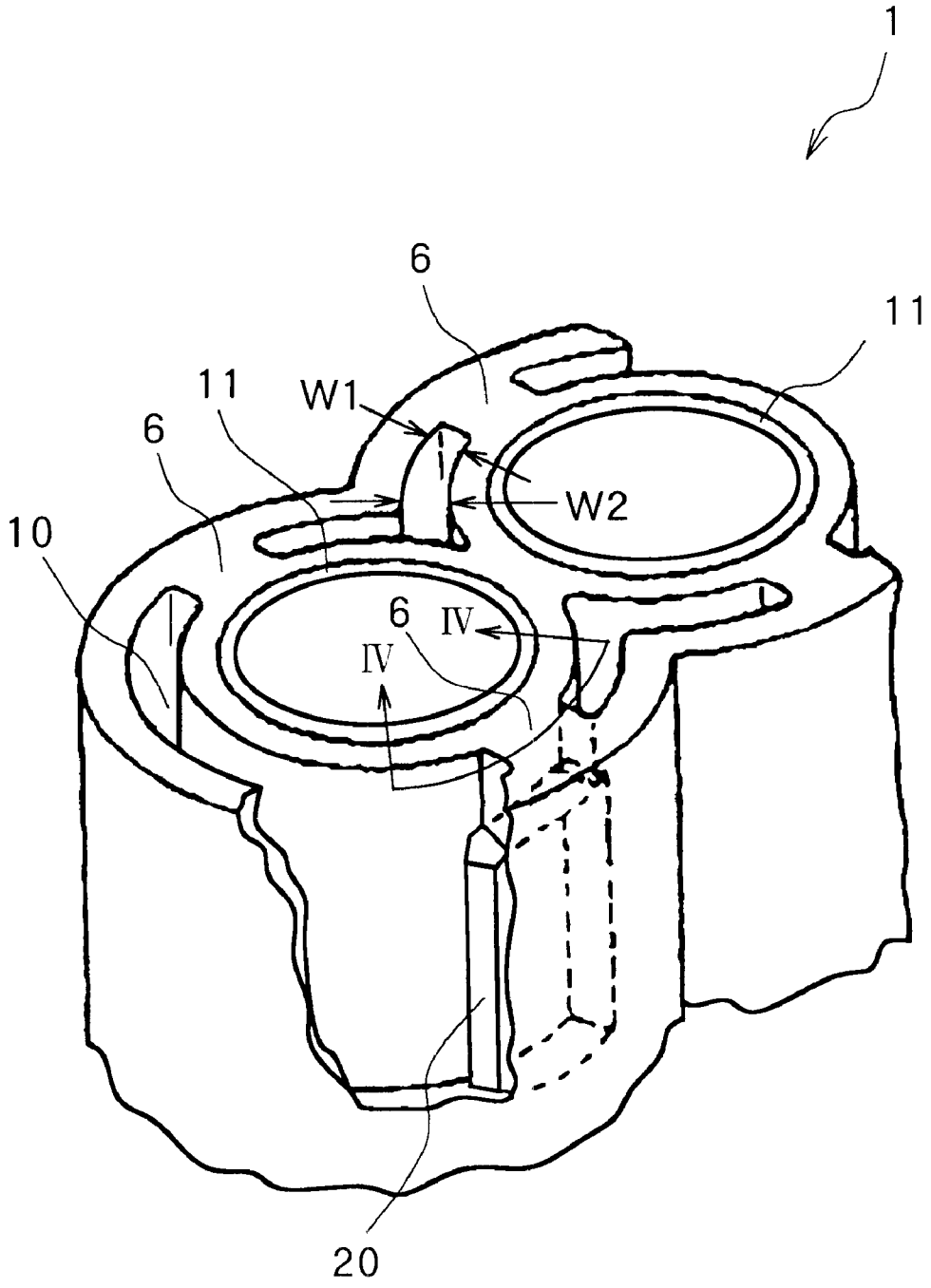
FIG. 2 is a perspective view partially cut away showing the closed deck type cylinder block produced by the metal mold arrangement according to the embodiment, and showing a state prior to removal of a separate core.

A top deck surface of a closed deck type cylinder block 1 for a four cylinder in-line engine is shown in FIG. 1, and a part of a casted cylinder block 1 is shown in FIG. 2. The cylinder block 1 is made from aluminum alloy, and is provided with a plurality of cylinder liners 11 juxtaposed with each other in sliding contact with pistons (not shown). A water jacket 10 is formed surrounding the cylinder liners 11. A width of the water jacket 10 in a radial direction of the cylinder is gradually increased toward a neighboring cylinder, i.e., W2 is greater than W1 in FIG. 1.

A cylinder head attaching stand 7*a* and an end portion 7*b* of the cylinders are separated from each other by the water jacket 10. However, in order to reduce engine vibration and to reinforce the top deck surface of the cylinder block 1, a plurality of bridge portions 6 are provided connecting together the cylinder head attaching stand 7*a* and the end portion 7*b*, so that an upper open end of the water jacket 10 is partly covered by the bridge portions 6. This type cylinder block is generally referred to as a closed deck type cylinder block. Incidentally, separate cores 20 (described later) can be positioned within the water jacket 10 and below the bridge portions 6 in the course of casting. All separate cores 20 will be removed from the water jacket 10 as described later.

Figure 3:
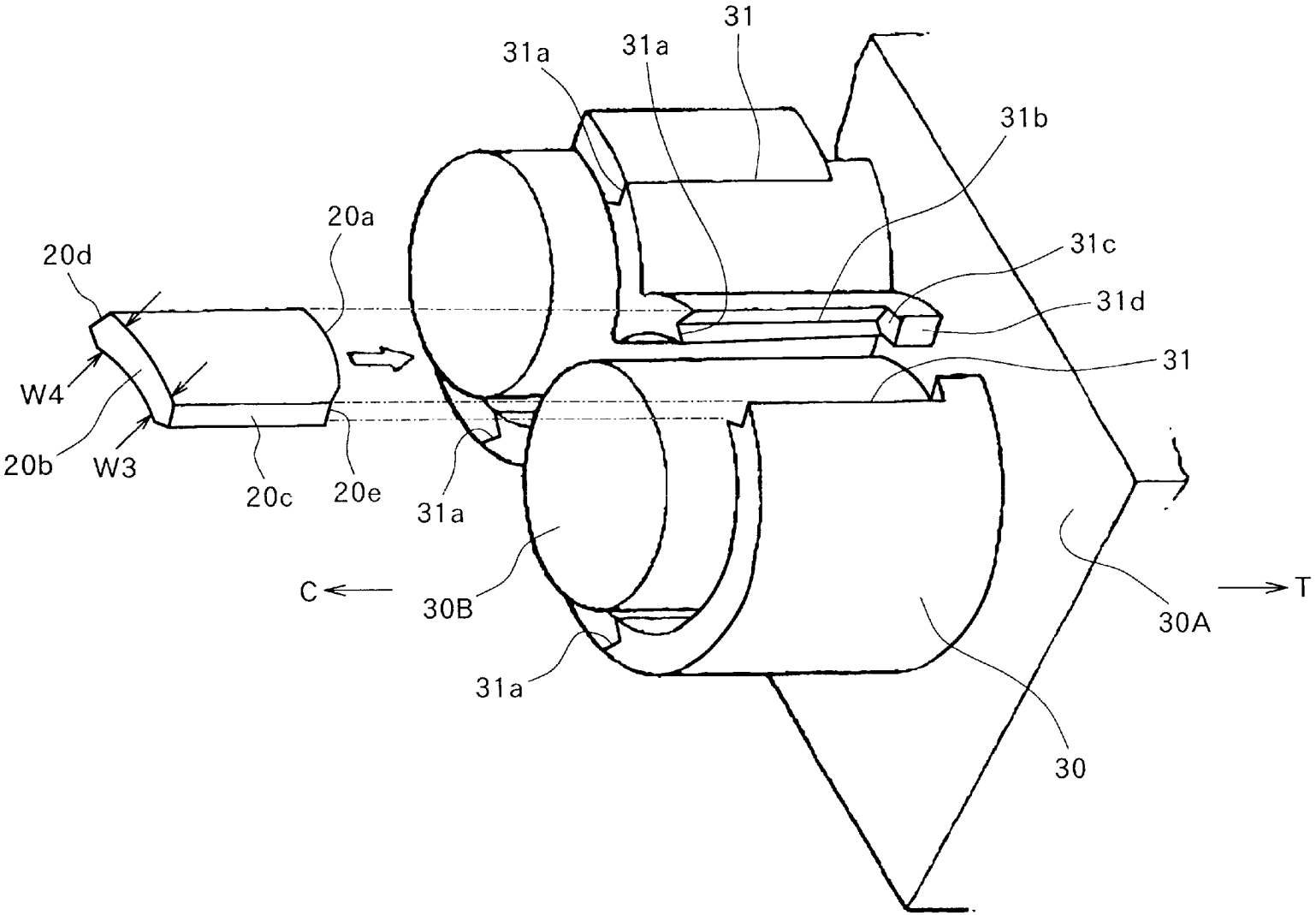
FIG. 3 is a perspective view showing an essential portion of the metal mold arrangement according to the embodiment of the present invention.
Figure 4:
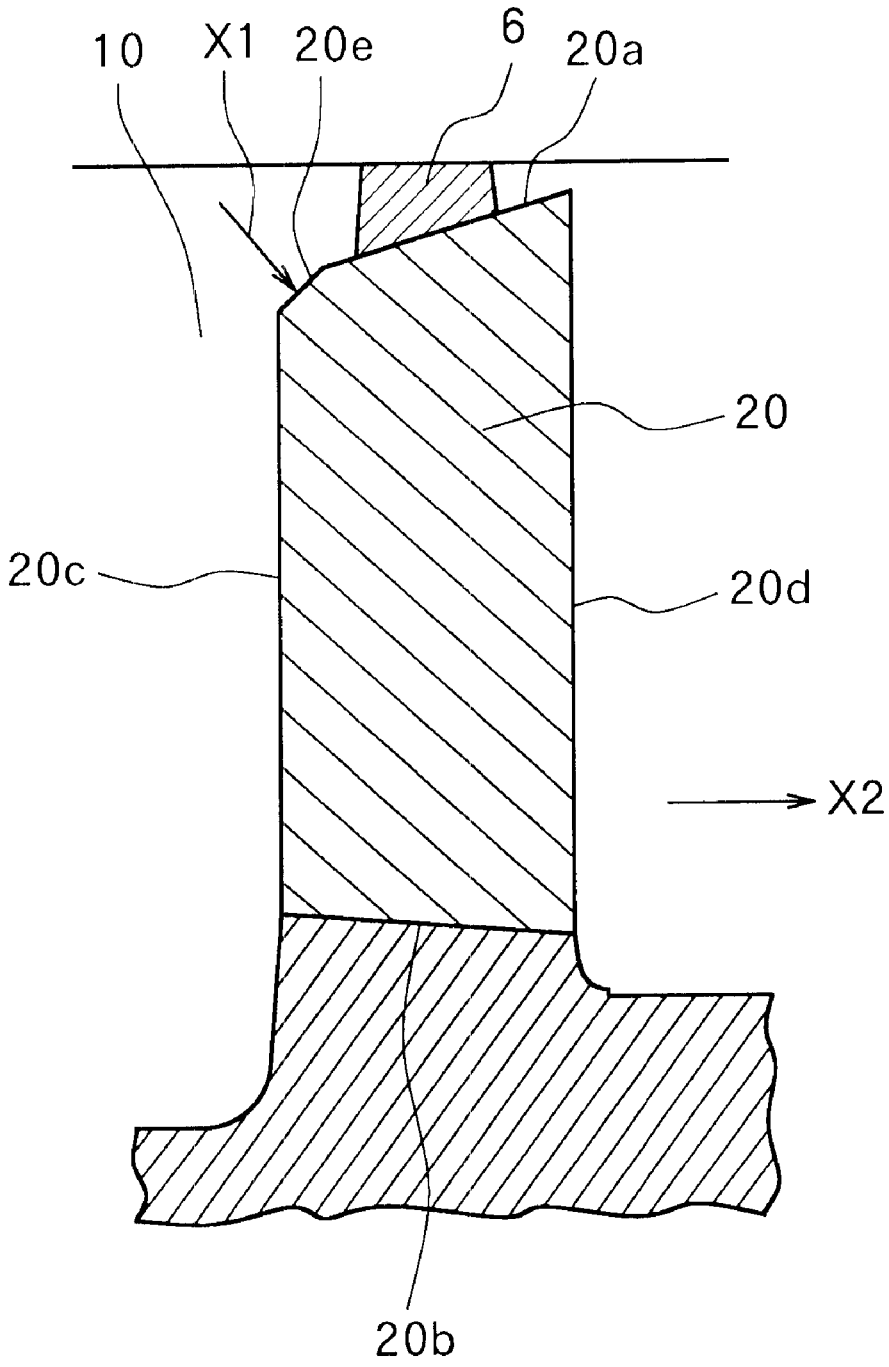
FIG. 4 is a cross-sectional view taken along a line IV—IV of FIG. 2.

A metal mold arrangement for producing the closed deck type cylinder block 1 is shown in FIGS. 3 and 4. In FIG. 3, a top deck side and a crank case side are indicated by arrows T and C, respectively. The metal mold arrangement includes a cylinder block forming die provided with a water jacket die portion 30 for forming the water jacket 10, and separate cores 20 fitted with the die portion 30 during casting. The cylinder block forming die also includes a wall section 30A for defining a top deck surface of the cylinder block and cylindrical protrusions 30B for defining cylinder bores. The cylinder block forming die also includes a second wall portion (not shown) for defining a configuration of a crankcase side face. The water jacket die portion 30 is disposed to surround the cylindrical protrusions 30B. The water jacket die portion 30 is formed with a plurality of recess portions 31. Each recess portion 31 has one open end 31*a* opened at the crankcase side C, and has generally rectangular shape extending in an axial direction of the cylinder. According to the depicted embodiment, two recessed portions 31 are symmetrically formed at positions generally 90 degrees with respect to the array of the cylinders. Each recessed portion 31 has opposing side walls 31*b* extending in the axial direction of the cylinder. Each opposing side wall 31*b* is formed with a groove having a moderate V-shape in cross-section. Each recessed portion 31 has a bottom surface 31*c* slanted so that a depth of the recess in the axial direction is not uniform but changed toward a circumferential direction. Each bottom surface 31*c* is further formed with a communication recess 31*d* communicating with the top deck end face, i.e., the wall section 30A of the die 30 at the top deck side T in FIG. 3.

In order to provide bridge portions 6, each separate core 20 is slidingly inserted into each recessed portion 31 from its open end 31*a*. The separate core 20 is of solid structure and has a generally rectangular shape and is formed from aluminum alloy. The separate core 20 has a top deck side slant end face 20*a* and a crank case side slant end face. 20*b*. The end faces 20*a* and 20*b* are slanted in opposite directions against each other such that a distance between the end faces 20*a* and 20*b* in the axial direction of the cylinder is gradually increased or decreased. For example, in FIG. 4, the distance between the end faces 20*a* and 20*b* is gradually increased toward rightwardly in a circumferential direction of the cylinder. Thus, the end faces 20*a* and 20*b* serve as drafts for facilitating removal of the separate core 20 from the casted product. Apparently, the slant angle of the top deck side slant end face 20*a* is coincident with the slant angle of the bottom surface 31*c* of the recessed portion 31. Further, the separate core 20 has side faces 20*c* and 20*d* engageable with the opposing side walls 31*b* of the recessed portion 31. The side faces 20*c* and 20*d* are in the form of moderate V shape protrusion (see FIG. 3) which is complementary with the V-shaped groove of the opposing side walls 31*b*. A width of the separate core 20 in a radial direction of an associated cylinder is gradually increased in a circumferential direction toward a neighboring cylinder. For example, in FIG. 3, a width W4 is greater than a width W3.

When the separate core 20 is inserted into the recessed portion 31 from its open end 31*a* until the top deck side end face 20*a* is brought into abutment with the bottom surface 31*c* of the recessed portion 31, the separate core 20 can be firmly engaged with the recessed portion 31 such that the movement of the separate core 20 relative to the recessed portion 31 in the axial direction of the cylinder can be prevented. Further, because of the engagement of the V-shaped grooves 31*a* and the complementary V-shaped projections 20*c* and 20*d*, the movement of the separate core 20 relative to the recessed portion in a radial direction of the cylinder can also be prevented.

A thickness of the separate core 20 is smaller than that of the water jacket die portion 30, so that, after casting the cylinder block, the separate core 20 can be moved along a circumferential direction of a water jacket 10 without any significant interference with a wall of the water jacket 10. If the thickness of the separate core 20 is greater than that of the water jacket die portion 30, the separate core 20 cannot be moved due to the mechanical interference with the wall of the water jacket 10. In the latter case, the separate core 20 cannot be removed out of the casted cylinder block.

As shown in FIG. 4, a chamfered portion 20*e* is formed at a corner between the top deck side end face 20*a* and the side surface 20*d*, that is, the chamfered portion 20*e* is positioned at the top deck side end face 20*a* and at a position which provides the shortest distance between the top deck side end face 20*a* and the crank case side end face 20*b*. As described above, the thickness of the water jacket die portion 30 is gradually increased toward the neighboring cylinder. Therefore, the chambered portion 20*e* is positioned at the thinner side of the water jacket die portion 20 when the separate core 20 is set into the water jacket die portion 30.

Next, a method for producing the cylinder block using the above described metal mold arrangement will be described. The separate core 20 is formed from aluminum alloy and is a solid structure with a simple configuration, and therefore, mass production of the separate cores 20 is available. Each separate core 20 is inserted into each recessed portion 31 from its open end 31*a* until the top deck side end face 20*a* is brought into abutment with the bottom surface 31*c* of the recessed portion 31. In this case, accurate position of the separate core 20 relative to the water jacket die portion 30 is achievable because of the engagement between,the V-shaped grooves 31*a*, 31*b* of the recessed portion 31 and complementary V-shaped projections 20*c*, 20*d* of the separate core 20 as shown in FIG. 3. By the combination of the water jacket die portion 30 and the separate cores 20, a contour of the water jacket 10 can be provided. Incidentally, a graphite can be coated over the surface of the separate cores 20 prior to the assembly of these separate cores 20 into the water jacket die portion 30 for facilitating removal of the separate cores from the casted product.

After the cylinder liners 11 are inserted around the cylindrical protrusions 30B, and by filling a molten aluminum alloy into the metal mold, the cylinder block 1 formed with the water jacket 10 is produced while the molten aluminum alloy surrounds the cylinder liners 11. In this case, the molten aluminum alloy is also filled into a space defined by the surface of the wall section 30A, the communication recess 31*d* and the top deck side end face 20*a* of the separate core 20. Thus, the bridge portion 6 is provided at a part of the open end of the water jacket 10.

When filling the molten metal, only one separate core 20 is positioned in each recessed portion 31. Therefore, burr generating portion can be reduced. Further, because the separate core 20 is of a solid construction, the separate core can withstand its deformation even upon application of high casting pressure. Furthermore, because the separate core 20 is formed from the aluminum alloy, any possible clearance between the separate core 20 and the recessed portion 31 can be absorbed or reduced because of sufficient thermal expansion of the separate core 20. It should be noted that thermal expansion coefficient of the aluminum alloy is higher than that of iron. Accordingly, a volume of burr can be reduced. Moreover, because of sufficient heat conduction coefficient of the aluminum alloy, the separate core provides high heat draining function. Accordingly, the molten metal entered into the clearance can be promptly cooled and solidified upon contact with the separate core 20. Thus, the solidified metal can prevent the burr from being deeply grown into the clearance.

After solidification of the molten metal, the metal mold is opened. In this case, since the separate cores 20 are mechanically interfered with the bridge portions 6, the recessed portions 31 of the water jacket die portion 30 slidingly move relative to the separate cores 20 to separate from the separate cores 20. Consequently, the separate cores 20 remain in the cylinder block 1.

Next, for removing the separate cores 20 from the cylinder block 1, a hammer is inserted in the water jacket 10 for striking the chamfered portion 20*e* in a direction indicated by an arrow X1 in FIG. 4. As a result, the separate core 20 can be moved toward a direction in which a distance between the drafts 20*a* and 20*b* (between the end faces 20*a* and 20*b*) is increased, i.e., in a direction X2 in FIG. 4. Because of the formation of the drafts 20*a* and 20*b*, the separate core 20 can be smoothly moved relative to the solidified bridge portion 6 and the bottom of the water jacket 10. Further, significant mechanical interference between the moving separate core 20 and the wall surface of the water jacket 10 does not occur because the radial thickness of the water jacket 10 is greater than that of the separate core 20 and because the thickness of the separate core 20 is gradually increased toward its moving direction. Furthermore, unwanted burrs can be adhered onto the separate core 20 because the separate core 20 and the molten metal are formed from the same or similar material. Accordingly, burrs do not remain in the metal mold because the burrs can be removed together with the removal of the separate core 2. Consequently, setting of new separate cores can be easily performed for a subsequent shot.

Next, a metal mold arrangement according to a second embodiment for producing a closed deck type cylinder block will be described. According to the first embodiment, the separate core is formed from aluminum alloy, which provides several advantages such that, (a) insertion of the separate core into the recessed portion 31 can be easily performed because of light weight of the separate core, (b) mass production of the separate cores is available because of the availability of a die casting method for producing the separate core, this is particularly advantageous in that a new separate core can be used at every shot (c) the separate core and the casted product can be melted together for a subsequent casting in a case where the separate core cannot be removed from the casted product. This is particularly advantageous in case of a trial shot. On the other hand, several disadvantages may be conceivable in such separate core formed from aluminum alloy. That is, (a) because the hardness of the aluminum alloy is lower than that of iron, when hammering the chamfered portion 20*e*, a dimple like deformation may be formed on the chamfered portion 20*e* instead of separation of the separate core from the bridge portion if an impacting surface area of the hammer is small, and (b) another metal mold is required for casting the separate cores.

According to the second embodiment separate cores formed from iron are used for the purpose of producing a small number of closed deck type cylinder block with various variations. Incidentally, shape of the separate core and the water jacket die portion is identical with that of the first embodiment. If the separate core formed of iron cannot be separated from the casted product, the separate core must be taken out from the molten metal after melting process to the casted product together with the separate core. In order to avoid this labor, extremely high separability of the separate core must be require with respect to the casted product in comparison with the separate core formed from aluminum alloy. Further, because the separate core formed from iron is repeatedly used, the molten metal may be adhered to the portion engaging with the recessed portion of the water jacket die portion, which in turn render the separate core to be difficult to be inserted into the recessed portion of the water jacket die portion. Accordingly, it is necessary to avoid adhesion of the molten metal to the engaging portion between the separate core and the recessed portion.

In order to avoid these problems, the separate core formed from iron is dipped into a mixture of graphite and aqueous parting agent prior to assembly of the separate core into the water jacket die portion. By the dipping, a first layer is provided over the iron, so that cooling efficiency and draftability or separability of the separate core from the casted product can be enhanced. Next, a metallic soap is coated over the separate core already subjected to dipping to form a second layer over the first layer. Zinc stearate calcium stearate and aluminum stearate are examples of the metallic soap. By the coating of the metallic soap, adhesion of aluminum alloy to the engaging portion of the separate core can be avoided. Such pretreated separate cores are inserted into the water jacket die portion, and filling of the molten aluminum alloy opening of the metal mold after solidification of the molten metal, and removal of the separate cores are conducted similar to the first embodiment.

Thus in the second embodiment, easy removal of the separate core from the casted product can result because of high hardness of the separate core. Further, parting or separating ability of the separate core from the casted product can be enhanced, and adhesion of the aluminum alloy to the separate core can be reduced because of the formation of the first and second layers over the separate core.

While the invention has been described in detail and with reference to the specific embodiments thereof, it would be apparent to those skilled in the art that various changes and modifications may be made therein without departing from the spirit and scope of the invention. For example, the cross-sectional shape of the groove at the side wall 21*a*, 31*b* and projection of the side wall 20*c*, 20*d* is not limited to V-shape (FIG. 3), but other shape such as arcuate shape is available. Further, the side walls of the recess can be protruded shape in cross-section, and side walls of the separate core can be grooved shape in cross-section.

Further, in the depicted embodiment, the chamfered portion 20*e* is formed at the predetermined corner portion of the separate core as shown in FIG. 4. However, the chamfered portion can be dispensed with as far as the separate core can be moved in the water jacket space upon impacting to a portion of the separate core.

Further, in the cylinder block shown in FIG. 1, additional bridge portions can be provided at each distal end of the cylinder block. Moreover, the metal mold arrangement according to the present invention can be applied for producing other type of engine such as a V-type engine and a flat engine (opposed-cylinder engine).

What is claimed is:

1. A metal mold arrangement for producing a closed deck type cylinder block made from an aluminum alloy, the cylinder block having a plurality of cylinder bores juxtaposed with each other to form a cylinder array and formed with a water jacket surrounding the cylinder array, the cylinder block also having a top deck at which one end of the water jacket is define as an open end, a plurality of bridge portions partly covering the open end, and a crankcase side end face opposite the top deck; the arrangement comprising:

a cylinder block forming die including at least a first wall portion defining a configuration of the top deck, a cylindrical protruding sections for defining an inner configuration of the cylinder block, a second wall portion defining a configuration of the crankcase side face, and a water jacket die portion positioned to surround the cylindrical protruding sections for defining a configuration of the water jacket, the water jacket die portion being formed with a plurality of recesses extending in an axial direction of the cylinder bores and opening at the crankcase side face, each recess being a rectangular shape having a pair of side wall surfaces, an opening positioned at the crankcase side face, and a bottom wall surface opposite the opening, the bottom wall surface extending in a direction intersecting with the axial direction and oblique to a direction of the array of the cylinders, the bottom surface being partly open to the first wall portion; and, a plurality of separate cores each having a solid structure and made from a metal and having a rectangular shape complementary to each recess, each single one of the separate cores being insertable into each recess in the axial direction from its opening, each separate core having a top deck side slant end face serving as a first draft and a crankcase side slant end face serving as a second draft, the top deck side face and the crankcase side face being slanted in opposite direction against each other such that a distance between the top deck side slant end face and the crankcase side slant end face in the axial direction of the cylinder is gradually increased toward a circumferential direction of the cylinder, an inclination of the bottom wall surface of each recess being coincident with an inclination of the top deck side slant end face.

2. The metal mold arrangement as claimed in claim 1, wherein each separate core has a chamfered portion at a corner portion provided at the top deck side slant end face and at a position which provides the, shortest distance between the top deck side end face and the crankcase side end face.

3. The metal mold arrangement as claimed in claim 1, wherein the water jacket die portion provides a thickness in a radial direction of the cylinder, the thickness being gradually increased toward a neighboring cylinder so that a thinner side, is positioned away from the neighboring cylinder and a thicker side is positioned close to the neighboring cylinder.

4. The metal mold arrangement as claimed in claim 3, wherein each separate core has a chamfered portion at a corner portion provided at the top deck side slant end face and at a position which provides the shortest distance between the top deck side end face and the crankcase side end face, the chamfered portion being set at the thinner side of the water jacket die portion when the separate core is set in the recess.

5. The metal mold arrangement as claimed in claim 3, wherein each separate core provides a thickness in the radial direction of the cylinder and the thickness of the separate core is smaller than the thickness of the water jacket die portion at its recess forming portion.

6. The metal mold arrangement as claimed in claim 1, wherein the pair of side wall surfaces of each recess are formed with grooves, and each separately core has a pair of protruding side wall surfaces engageable with the grooves.

7. The metal mold arrangement as claimed in claim 1, wherein each separate core is formed from aluminum alloy.

8. The metal mold arrangement as claimed in claim 7, wherein each separate core has a chamfered portion at a corner portion provided at the top deck side slant end face and at a position which provides the shortest distance between the top deck side end face and the crankcase side end face.

9. The metal mold arrangement as claimed in claim 7, wherein the water jacket die portion provides a thickness in a radial direction of the cylinder, the thickness being gradually increased toward a neighboring cylinder so that a thinner side is positioned away from the neighboring cylinder and a thicker side is positioned close to the neighboring cylinder.

10. The metal mold arrangement as claimed in claim 9, wherein each separate core has a chamfered portion at a corner portion provided At the top deck side slant end face and at a position which provides the shortest distance between the top deck side end face and the crankcase side end face, the chamfered portion being set at the thinner side of the water jacket die portion when the separate core is set in the recess.

11. The metal mold arrangement as claimed in claim 9, wherein each separate core provides a thickness in the radial direction of the cylinder, and the thickness of the separate core is smaller than the thickness of the water jacket die portion at its recess forming portion.

12. The metal mold arrangement as claimed in claim 7, wherein the pair of side wall surfaces of each recess are formed with grooves, and each separate core has a pair of protruding side wall surfaces engageable with the grooves.

13. The metal mold arrangement as claimed in claim 1, wherein the separate core is formed from iron.

14. The metal mold arrangement as claimed in claim 13, further comprising an inner coating formed on the separate core and composed of a mixture of a graphite and aqueous parting agent; and an outer coating formed on the inner coating and composed of a metallic soap.

15. The metal mold arrangement as claimed in claim 14, wherein each separate core has a chamfered portion at a corner portion provided at the top deck side slant end face and at a position which provides the shortest distance between the top deck side end face and the crankcase side end face.

16. The metal mold arrangement as claimed in claim 14, wherein the water jacket die portion provides a thickness in a radial direction of the cylinder, the thickness being gradually increased toward a neighboring cylinder so that a thinner side is positioned,away from the neighboring cylinder and a thicker side is positioned close to the neighboring cylinder.

17. The metal mold arrangement as claimed in claim 16, wherein each separate core has a chamfered portion at a corner portion provided at the top deck side slant end face and at a position which provides the shortest distance between the top deck side end face and the crankcase side end face, the chamfered portion being set at the thinner side of the water jacket die portion when the separate core is set in the recess.

18. The metal mold arrangement as claimed in claim 16, wherein each separate core provides a thickness in the radial direction of the cylinder, and the thickness of the separate core is smaller than the thickness of the water jacket die portion at its recess forming portion.

19. The metal mold arrangement as claimed in claim 14, wherein the pair of side wall surfaces of each recess are formed with grooves, and each separate core has a pair of protruding side wall surfaces engageable with the grooves.

* * * * *